United States Patent [19]

Tateno et al.

[11] 4,059,088

[45] Nov. 22, 1977

[54] THROTTLE POSITIONER

[75] Inventors: Hidenori Tateno, Nagoya; Tetsuomi Tamura, Toyota, both of Japan

[73] Assignee: Toyota Jidosha Kogyo Kabushiki Kaisha, Japan

[21] Appl. No.: 532,510

[22] Filed: Dec. 13, 1974

[30] Foreign Application Priority Data

May 28, 1974 Japan ..... 49-059918

[51] Int. Cl.[2] ..... F02D 11/08

[52] U.S. Cl. ..... 123/103 R; 123/198 DB; 123/DIG. 11

[58] Field of Search ..... 123/103 R, 103 D, 103 E, 123/97 B, 110, DIG. 11, 198 DB, 198 D; 261/65, DIG. 19

[56] References Cited

U.S. PATENT DOCUMENTS

| | | | |
|---|---|---|---|
| 3,682,142 | 8/1972 | Harrison et al. | 123/103 R X |
| 3,682,148 | 8/1972 | Harrison et al. | 123/103 R X |
| 3,752,141 | 8/1973 | Charron et al. | 123/103 R X |
| 3,760,785 | 9/1973 | Harrison et al. | 123/103 R X |
| 3,788,288 | 1/1974 | Harrison et al. | 123/103 R X |
| 3,911,880 | 10/1975 | Gropp | 123/117 A |

*Primary Examiner*—Ronald H. Lazarus
*Assistant Examiner*—Ira S. Lazarus
*Attorney, Agent, or Firm*—Birch, Stewart, Kolasch and Birch

[57] ABSTRACT

A throttle positioner to ensure a predetermined minimum opening of a throttle valve when an engine is abruptly decelerated from a relatively high speed condition, said positioner being adapted to be switched over between operating and non-operating conditions by alternating the introduction of intake tube vacuum or atmospheric pressure into a diaphragm means, wherein a combination of a check valve and constricting means is provided to optionally determine the time constant of said switching over operation.

4 Claims, 5 Drawing Figures

FIG. 3
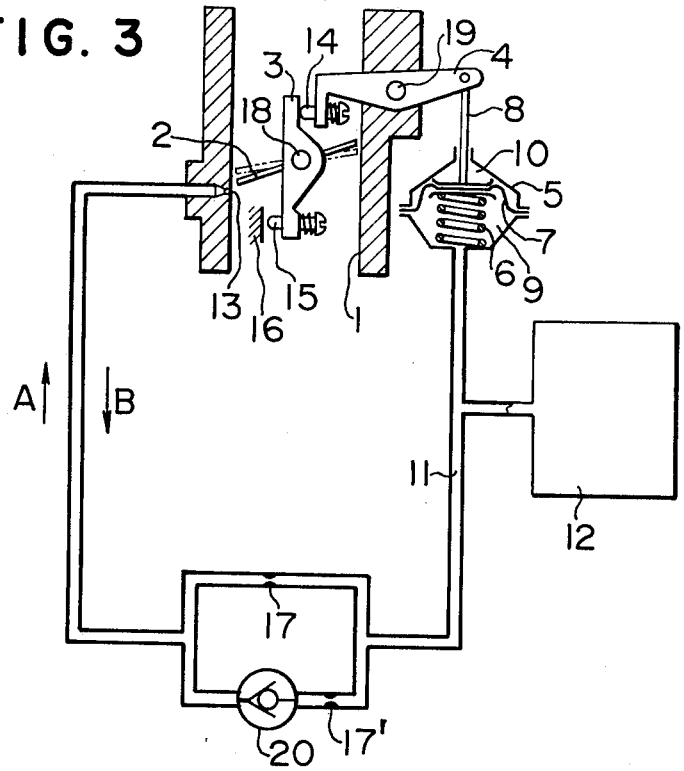
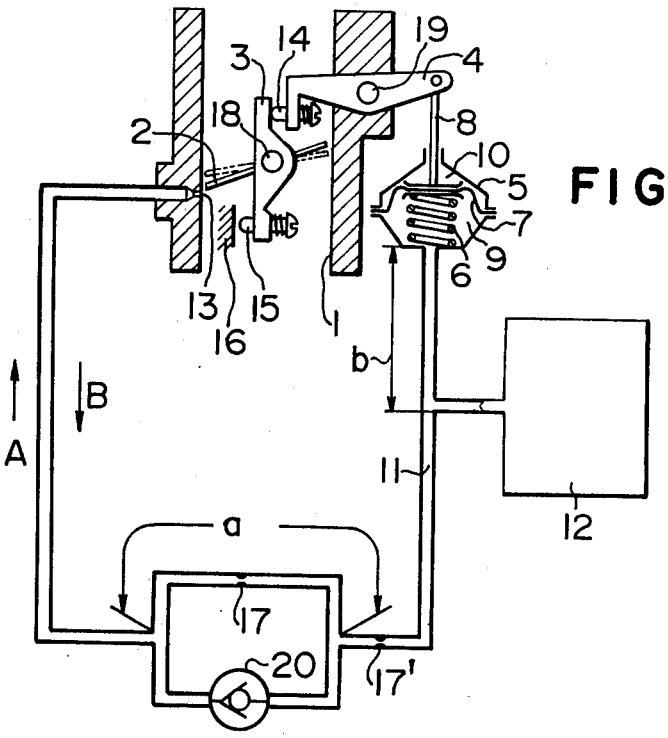
FIG. 4

THROTTLE POSITIONER

BACKGROUND OF THE INVENTION

1. Field of the Invention

The present invention relates to a throttle positioner which is attached to a carburetor for the purpose of reducing the emission of harmful gases, especially HC (Hydrocarbon) gases from an automobile in its decelerating condition.

2. Description of the Prior Art

When an automobile is decelerated, a throttle valve of the carburetor is generally closed to its idling position while the engine is still rotating at a relatively high speed. Thus, a relatively high vacuum is generated in an intake tube of the engine with the result that fuel which has been attached to the inner wall of the intake tube is rapidly vaporized and rich fuel air mixture is supplied to engine cylinders. Therefore, incomplete combustion of fuel is caused, resulting in a high increase in the amount of uncombusted components such as HC included in the exhaust gas. Furthermore, due to an extreme reduction of the amount in the intake fuel air mixture, the ratio of exhaust residue increases with the simultaneous increase in the possibility of misfiring. As a countermeasure to this problem, it has been proposed to hold the throttle valve at a predetermined position which is slightly opened from the idling position thereby to increase the amount of intake mixture at a level sufficient to maintain the complete combustion process in the engine. Such a means is called a throttle positioner.

A conventional throttle positioner will now be explained with reference to FIG. 1. An intake tube 1 of a carburetor is mounted with a throttle valve 2, which is adapted to rotate around a shaft 18 from its almost completely closed idling position shown in phantom lines toward an optionally opened running position by being actuated by a throttle operating mechanism (not shown) in accordance with the depression of an acceleration pedal. Relatively close to the idling position, a throttle positioner opening position is provided as shown by the solid lines wherein the throttle valve is opened just enough to reduce the intake vacuum in a decelerating condition sufficiently to accomplish complete combustion and suppress emission of uncombusted components. The throttle valve 2 is rotatably mounted on the shaft 18 and rotates therearound as a unitary body with an arm 3. The arm 3 is provided with a stopper screw 15 at one end thereof, said stopper screw being adapted to abut against a stopper 16 thereby holding the throttle valve at its idling position. The other end of the arm is adapted to abut against a stopper screw 14 provided at one end of a lever 4 which is pivoted around a shaft 19. The other end of the lever 4 is connected to a diaphragm 7 by a rod 8, said diaphragm being mounted in a diaphragm case 5 and applied with a biasing force by a compression coil spring 6 abutting against its underside. A diaphragm chamber 9 housing the spring 6 communicates with the inside of the intake tube 1 by a conduit means 11 including an air chamber 12 and a constricting means 17. The diaphragm chamber 9 is selectively supplied with vacuum through the conduit means 11, whereas a diaphragm chamber 10 is constantly supplied with atmospheric pressure. In this structure, when the diaphragm chamber 9 is not supplied with vacuum, the diaphragm is biased upward as seen in the drawing by the action of the compression coil spring 6, whereby the lever 4 is rotated counterclockwise by way of the rod 8 so that the stopper screw 14 traverses the rotary trace of the associated end of the arm 3 and holds the throttle valve 2 at the throttle positioner opening position which is slightly opened from the idling position.

However, if the throttle positioner is operated in the idling condition of the engine, the idling speed of the engine becomes high, making the driver uncomfortable as well as adversely affecting the fuel consumption rate. When the engine is decelerated while it is operating at a relatively low speed, an extremely high vacuum is not generated in the intake tube, and misfiring is generally not caused and emission of HC is usually very low. Therefore, the throttle positioner must not be operated in the idling or decelerating condition at a low speed, but rather the throttle positioner is to be operated only when the engine is decelerated while operating at a high speed above a predetermined level. In order to lock the operation of the throttle positioner when the engine is decelerated while it is operating at a low speed, the open end 13 of the vacuum conduit 11 is positioned to open to the inner wall of the intake tube 1 slightly downstream of the position where the end of the throttle valve 2 opposes the wall of the intake tube when it is positioned at the throttle positioner opening position to reduce emission of uncombusted components. Thus, when the acceleration pedal has been depressed, the opening 13 is applied with substantially atmospheric pressure whereas it is applied with a vacuum only when the throttle valve is in the range between the idling position and the position set by the throttle positioner. Therefore, as long as the engine is operating at a low speed or decelerating condition with the throttle valve 2 being positioned within a region not to traverse beyond the open end 13, the vacuum in the intake tube is always applied to the diaphragm 7, whereby it is pulled downward, turning the lever 4 clockwise as seen in the drawing by way of the rod 8 so that the stopper screw 14 is held out of engagement with the throttle arm 3. In this condition, the throttle valve 2 returns to its idling position as shown by phantom lines.

When the vehicle is running above a predetermined speed, the throttle valve 2 is opened beyond the open end 13 by stepping on the acceleration pedal, wherein the open end 13 is positioned upstream of the throttle valve 2. In this condition, the diaphragm chamber 9 is supplied with atmospheric pressure, and therefore, the lever 4 is held in the position as shown in FIG. 1 by the action of the spring 6. Then, if the acceleration pedal is released to effect deceleration, the throttle valve 2 is returned to the position as shown by solid lines determined by engagement of the stopper screw 14 of the lever 4 with the associated end of arm 3, wherein the throttle valve is slightly opened from the idling position shown by phantom lines to a degree sufficient to effect complete combustion and to suppress emission of uncombusted components. After the throttle valve has been set to the abovementioned position, the vacuum in the intake tube increases and, since the opening end 13 is now positioned downstream of the throttle valve 2, the vacuum in the intake tube is transmitted through the conduit means 11 toward the diaphragm means. However, due to the use of the constricting means 11 and an air chamber 12 operating as an accumulator, the effective transmission of the vacuum from the open end 13 to the diaphragm chamber 9 is delayed. When the diaphragm chamber 9 has been effectively evacuated, the diaphragm 7 is pulled down against the action of the spring 6, moving the rod 8 downward and turning the lever 4 clockwise to disengage it from the arm 3. Thus, the throttle valve 2 returns to its idling position as shown by phantom lines. Therefore, the throttle valve 2 is kept at the HC reduction opening position for a period determined by the constricting means 17 and the air chamber 12.

After the throttle valve has been returned to the idling position, if the acceleration pedal is depressed to start the vehicle, the throttle valve 2 is opened by traversing the open end 13 so that the opening is positioned upstream thereof, whereby atmospheric pressure is again introduced into the diaphragm chamber 9. In this case, a time delay of the same kind is effected by the constricting means 17 and the air chamber 12 before the diaphragm chamber 9 is completely filled with air at atmospheric pressure. Therefore, in a vehicle equipped with the conventional throttle positioner as explained above, if the acceleration pedal has once been depressed to start the vehicle thereby opening the throttle valve from the idling position, and immediately thereafter, the acceleration pedal is released to effect deceleration, the lever 4 has not yet been returned to the position to hold the throttle valve 2 at said HC reduction opening position due to the aforementioned delay in transmitting atmospheric pressure into the diaphragm chamber 9 and, accordingly, the throttle valve is returned to the idling position beyond the HC reduction opening position, whereby a high emission of HC in the exhaust gas occurs. Furthermore, the operating time to set the stopper screw 14 of the lever 4 to the throttle positioner operating position or to release it from its operating position is determined by the constricting means 17 and the air chamber 12 provided in the conduit means 11 and, if the period during which the stopper screw 14 is set at the throttle positioner operating position is to be longer, the time required for setting the stopper screw 14 becomes also longer. In other words, it has been impossible to determine independently the period in which the throttle positioner operating condition is held and the time required for the setting.

SUMMARY OF THE INVENTION

Therefore, it is the object of the present invention to provide an improved throttle positioner wherein the time required for atmospheric pressure to fill the diaphragm chamber 9 is relatively shortened thereby shortening the time required for the setting of the throttle positioner while keeping the period in which the throttle positioner is set at the operating condition to be long as usual so that even when the vehicle is driven in the aforementioned mode, the throttle valve 2 is positioned at the uncombusted component reduction opening position.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the aforementioned object is accomplished by a throttle positioner which insures a predetermined minimum opening of a throttle valve when an engine is abruptly decelerated from a relatively high speed condition. The throttle positioner comprises a member movable between a first position where it traverses a trace of rotation of a throttle arm and a second position where it is held out of said trace, a diaphragm means adapted to operate with a vacuum in an intake tube so as to bias said member toward said second position when vacuum of a substantial level is applied thereto, and conduit means to supply the vacuum in the intake tube to said diaphragm means, said conduit means including an air chamber to operate as a response delay capacity, characterized in that a check valve and constricting means assembly are disposed in parallel in said conduit means, said check valve being oriented to allow flow only from the intake tube to said diaphragm means. According to further features of the present invention, a second constricting means may be provided in series with said check valve or in series with said assembly. With this arrangement, it is made possible not only to determine the period during which the throttle positioner operates independently of the time required for the setting of the throttle positioner, but also to adjust said period and time at any optional value.

The same advantage is also obtained according to a further feature of the present invention by providing a second parallel assembly of a check valve and a constricting means in series with the first mentioned assembly in a manner that the check valve in said second assembly is oppositely oriented with respect to the check valve in said first assembly.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
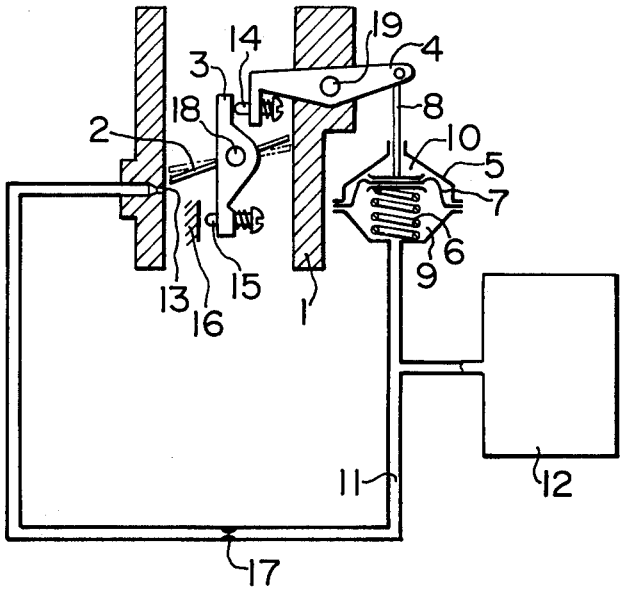
FIG. 1 PRIOR ART
FIG. 1 is a diagram showing the constitution of the conventional throttle positioner.
Figure 2:
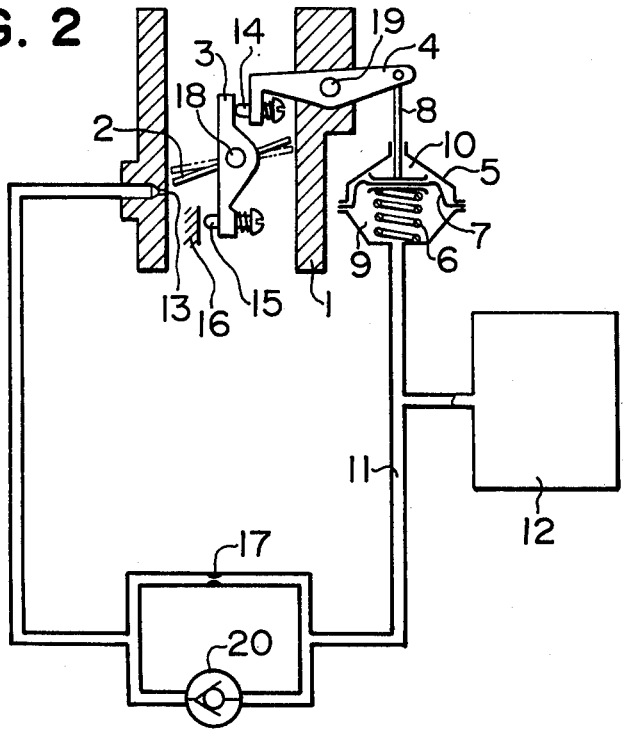
FIG. 2 is a diagram showing the basic constitution of the throttle positioner according to the present invention; and, FIGS. 3–5 are views similar to FIG. 2 but showing several modifications of the constitution shown in FIG. 2.

In the following, the present invention will be described in more detail with respect to some preferred embodiments by referring to FIGS. 2–5. Referring to FIG. 2, the portions corresponding to those shown in FIG. 1 are designated by the same reference numerals and apparently operate in the same manner as those in FIG. 1. In the throttle positioner shown in FIG. 2, a system comprising check valve 20 which is oriented to allow flow of air through the conduit means 11 from the open end 13 toward the diaphragm chamber 9 but to prevent flow in the opposite direction is provided in parallel with the constricting means 17 said system being disposed in the conduit means 11. When the throttle valve 2 has been opened from the idling position shown by phantom lines due to stepping on the acceleration pedal, the open end 13 is applied with atmospheric presure which is transmitted through the check valve 20 so that the air chamber 12 and the diaphragm chamber 9 are rapidly filled with air at atmospheric pressure, whereby the diaphragm 7 is biased upward by the action of the spring 6 which sets the lever 4 to its operating position as shown in FIG. 2. Therefore, even when the acceleration pedal has been released to effect deceleration after it has once been stepped on, the throttle valve 2 is not returned to the idling position but is held at the HC reduction opening position. When the throttle valve 2 is held at the throttle positioner operating position as shown in FIG. 2, the open end 13 of the conduit 11 is positioned downstream of the throttle valve 2 and, accordingly, the vacuum generated in the intake tube 1 due to the intake action of the engine is applied to the open end 13. However, since the air flow through the check valve 20 toward the open end 13 is prevented, the application of the vacuum to the diaphragm 7 is delayed by the function of the constricting means 17 and the air chamber 12. During this delay period, the throttle valve 2 is held at the uncombusted component reduction opening position wherein it is slightly opened from the idling position.

Thus, it will be appreciated that according to the present invention, the time required for the setting of the throttle positioner can be extremely shortened by the swift flowing-in of air into the diaphragm chamber 9. Therefore, even in an operating mode such as to transfer from deceleration to acceleration and again decelerate from normal running, the throttle valve 2 can be held at the uncombusted component reduction opening position, resulting in reduced emission of HC in the exhaust gas.

FIGS. 3 and 4 show two modifications of the throttle positioner according to the present invention. Also in these figures, the portions corresponding to those shown in FIGS. 1 and 2 are designated by the same reference numerals. In the modification shown in FIG. 3, a second constricting means 17' is provided in series with the check valve 20, while in the modification shown in FIG. 4 a second constricting means 17' is provided in series with a parallel assembly of the constricting means 17 and the check valve 20. The constricting means 17' in the latter modification may be provided in any position of the conduit 11 other than portions *a* and *b* thereof.

In the modification shown in FIG. 3, when air flows in direction A, the check valve 20 is kept closed. Therefore, the air flow is restricted by the first constricting means 17. Therefore, the time delay in the application of vacuum to the diaphragm 7 is optionally determined by properly designing the through opening of the first constricting means 17. When air flows in direction B, the check valve 20 opens to allow the air to flow. In this case, therefore, the air flow is regulated by the first and second constricting means 17 and 17'. Since the performance of the first constricting means 17 has been determined to give a desired delay in applying vacuum to the diaphragm 7, the time in which atmospheric pressure is applied to the diaphragm 7 can be optionally determined by properly designing the through opening of the second constricting means 17'.

In the modification of FIG. 4, when air flows in direction B, the check valve 20 allows the air to flow and, accordingly, the air flow is regulated substantially by the second constricting means 17'. Therefore, the time required for applying atmospheric pressure to the diaphragm 7 can be optionally determined by properly designing the through opening of the second constricting means 17'. When air flows in direction A, the check valve 20 is closed and, accordingly, the air flow is regulated by the first and second constricting means 17 and 17'. Since the performance of the second constricting means 17' has been determined to give a desired time in applying atmospheric pressure to the diaphragm 7, the time required for applying vacuum to the diaphragm 7 can be optionally determined by properly designing the through opening of the first constricting means 17. Thus, in the modifications shown in FIGS. 3 and 4, the time required for the setting of the stopper screw 14 to its operating position and the period in which the throttle positioner operating position is held can be independently determined by properly designing the first and second constricting means.

Figure 5:
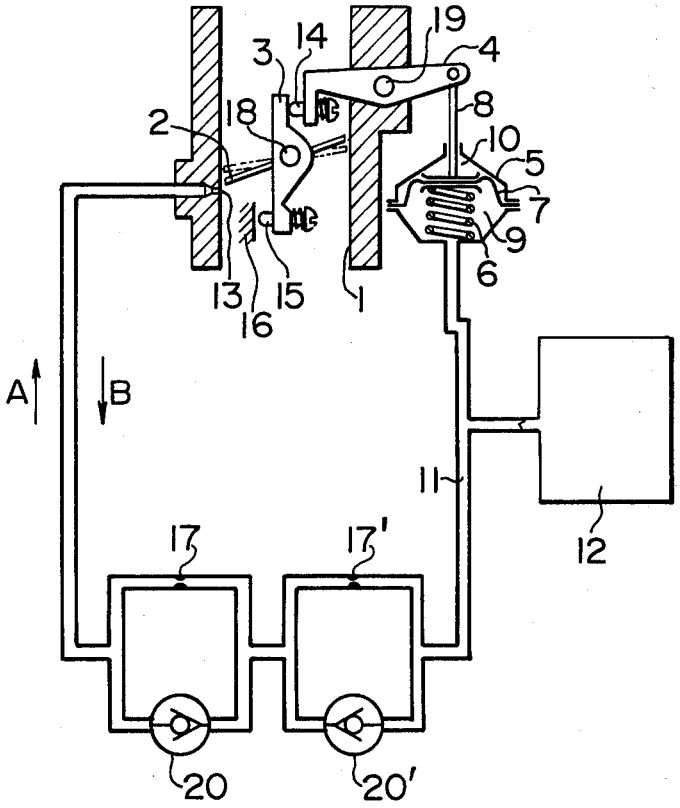

FIG. 5 shows a further modification of the present invention. This modification includes a first parallel assembly of the constricting means 17 and the check valve 20 and a second parallel assembly of a constricting means 17' and a check valve 20'. This second check valve 20' is oriented oppositely with respect to the first check valve 20. When air flows in direction A in this modification, the first check valve 20 allows the air to flow while the second check valve 20' does not allow the air to flow. Therefore, air flow is regulated by the second constricting means 17'. Thus, the time delay in applying vacuum to the diaphragm 7 can be optionally determined by properly designing the through opening of the second constricting means 17'. When air flows in direction B, the first check valve 20 does not allow the air to flow, while the second check valve 20' allows the air to flow. Accordingly, the air flow is regulated by the first constricting means 17. Thus, the time delay in applying atmospheric pressure to the diaphragm 7 can be optionally determined by properly designing the through opening of the first constricting means 17. The position of the first check valve 20 may be changed with that of the second check valve 20'. Thus, it will be appreciated that the fourth embodiment shown in FIG. 5 also allows for determining the time required for the setting of the throttle positioner and the period in which the throttle positioner is maintained at its operating condition independently of each other.

Although the air chamber 12 has been included in all embodiments described above, this element can be omitted by properly restricting the through opening of the constricting means 17 and/or 17'.

In summary, the present invention provides a throttle positioner in which the period of holding the throttle positioner at its operating condition is the same as the conventional one while the time required for the setting of the lever 4 to the throttle positioner operating position can be shortened. By this arrangement, even in a driving mode of transferring from deceleration to acceleration or of immediately decelerating after normal running, the throttle valve 2 is kept at the uncombusted component reduction opening position, suppressing emission of harmful HC in the exhaust gas.

Furthermore, in the case of the second, third and fourth modifications, the time required to set the lever 4 at its operating position can be optionally determined to provide the most favorable operation of the throttle positioner. For example, in the case of the basic embodiment of the present invention, if the acceleration pedal has been deeply depressed in the idling condition to race the engine, the throttle valve 2 will be held at the uncombusted component reduction opening after the end of the racing, whereby the engine is kept at a rotational speed higher than idling, thus making the driver uncomfortable and deteriorating the fuel consumption rate. This drawback is obviated in the second, third and fourth embodiments of the present invention by properly extending the time required to set the lever 4 at the throttle positioner operating position, whereby the throttle valve 2 can be returned to the idling position even after the racing of the engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A throttle positioner to ensure a predetermined minimum opening for a throttle valve in an internal combustion engine when the engine is abruptly decelerated from a relatively high-speed condition, comprising a throttle arm connected with a shaft of the throttle valve, a member movable between a first position where it traverses a trace of movement of the throttle arm and a second position where it is held out of said trace, a diaphragm means adapted to operate with the intake vacuum of the engine so as to bias said member toward said second position when the intake vacuum is applied thereto, a port which opens to an intake passage of the engine at a position which is downstream of the throttle valve when it is closed until said throttle arm engages said movable member, and is upstream of the throttle valve when it is opened with said throttle arm not being in engagement with said movable member, and a conduit means which connects said port with said diaphragm means, said port and conduit means including a buffering air chamber and a parallel assembly of a check valve and a constricting orifice means disposed therein, said check valve being oriented to allow fluid to flow only toward said diaphragm means.

2. The throttle positioner of claim 1, which further includes a second constricting orifice means provided in series with said check valve.

3. A throttle positioner according to claim 1, wherein a second constricting means is provided in series with said assembly.

4. A throttle positioner according to claim 1, wherein a second parallel assembly of a check valve and a constricting means is provided in series with the first mentioned assembly, the check valve in said second assembly being oppositely oriented with respect to the check valve in said first assembly.

* * * * *